US011166362B2

(12) United States Patent
Ma et al.

(10) Patent No.: US 11,166,362 B2
(45) Date of Patent: Nov. 2, 2021

(54) COMPACT INTEGRATED DEUTERIUM-DEUTERIUM NEUTRON GENERATOR

(71) Applicant: Lanzhou University, Lanzhou (CN)

(72) Inventors: Zhanwen Ma, Lanzhou (CN); Ze'en Yao, Lanzhou (CN); Yu Zhang, Lanzhou (CN); Zhiwu Huang, Lanzhou (CN); Junrun Wang, Lanzhou (CN); Xiaolong Lu, Lanzhou (CN); Zheng Wei, Lanzhou (CN)

(73) Assignee: Lanzhou University, Lanzhou (CN)

( * ) Notice: Subject to any disclaimer, the term of this patent is extended or adjusted under 35 U.S.C. 154(b) by 28 days.

(21) Appl. No.: 16/790,051

(22) Filed: Feb. 13, 2020

(65) Prior Publication Data

US 2020/0265967 A1 Aug. 20, 2020

(30) Foreign Application Priority Data

Feb. 14, 2019 (CN) ..... 201910114085.9

(51) Int. Cl.
*H05H 3/06* (2006.01)
*G21G 4/02* (2006.01)
*H05H 6/00* (2006.01)

(52) U.S. Cl.
CPC ..... *H05H 3/06* (2013.01); *G21G 4/02* (2013.01); *H05H 6/00* (2013.01)

(58) Field of Classification Search
CPC ..... G21G 4/02; H05H 3/06
See application file for complete search history.

(56) References Cited

U.S. PATENT DOCUMENTS 3,084,256 A * 4/1963 Tittle ..... G01V 5/10 376/111
3,657,536 A * 4/1972 Langford ..... H01R 13/533 174/110 FC (Continued)

FOREIGN PATENT DOCUMENTS

CN 102548181 A 7/2012
CN 104244560 A 12/2014

(Continued)

*Primary Examiner* — Sharon M Davis
(74) *Attorney, Agent, or Firm* — Troutman Pepper Hamilton Sanders LLP; Christopher C. Close, Jr.

(57) ABSTRACT

The present invention discloses a compact integrated deuterium-deuterium (D-D) neutron generator. A hemispherical metal head is disposed inside a cylindrical ceramic shell of the generator and is provided therein with an ion source and an ion source power supply. An inner ceramic insulated cylinder and an outer ceramic insulated cylinder are disposed between a metal plate of the metal head and a baseplate of the generator, and an isolated power supply system and a high-voltage power supply are disposed between the inner ceramic insulated cylinder and the outer ceramic insulated cylinder. A rear end of an extraction accelerating electrode disposed inside the inner ceramic insulated cylinder protrudes from the generator and is then connected to a target holder disposed outside the baseplate. A target is disposed inside the target holder, the target is at ground potential, and a cooling water interface is disposed on the target holder.

13 Claims, 1 Drawing Sheet

(56) References Cited

U.S. PATENT DOCUMENTS

| | | | | |
|---|---|---|---|---|
| 5,135,704 | A * | 8/1992 | Shefer | H05H 3/06 376/108 |
| 6,925,137 | B1 * | 8/2005 | Forman | H05H 3/06 376/108 |
| 2011/0044418 | A1 * | 2/2011 | Stubbers | G21B 1/19 376/116 |
| 2013/0294557 | A1 * | 11/2013 | Perkins | H05H 7/02 376/115 |
| 2018/0206323 | A1 * | 7/2018 | Kobernik | H01P 3/123 |

FOREIGN PATENT DOCUMENTS

| | | | |
|---|---|---|---|
| CN | 101978429 | B | 4/2015 |
| CN | 105407621 | B | 1/2018 |

* cited by examiner

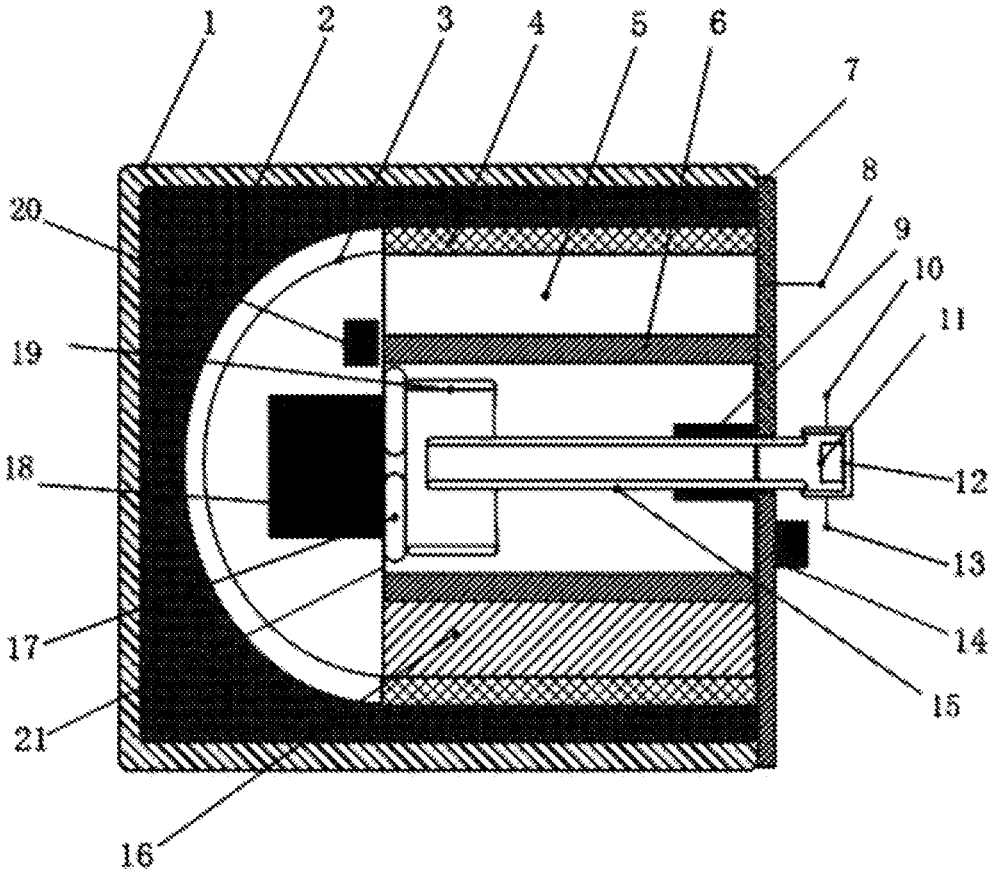
1
2
3
4
5
6
7
8
9
10
11
12
13
14
15
16
17
18
19
20
21

COMPACT INTEGRATED DEUTERIUM-DEUTERIUM NEUTRON GENERATOR

CROSS REFERENCE TO RELATED APPLICATIONS

This application claims priority, and benefit under 35 U.S.C. § 119(e) of Chinese Patent Application No. 201910114085.9 filed 14 Feb. 2019. The disclosure of the prior application is hereby incorporated by reference as if fully set forth below.

TECHNICAL FIELD

The present invention relates to the technical field of neutron generators, and in particular, to a compact integrated deuterium-deuterium (D-D) neutron generator.

BACKGROUND

Deuterium-deuterium (D-D) neutron generators are accelerator-based neutron generators, where neutrons are generated by the D-D fusion reaction. For DD neutron generators, deuterium ions generated from the ion source is bombing the target after being accelerated in an electronic field and the neutron is generated in the target. DD neutron generators can achieve a high neutron yield with a low cost and compact structure, which can be widely used in field such as neutron activation analysis, neutron radiography, and physics research. For the reason that a compact neutron generator can reduce the size of the neutron activation analysis system and neutron radiography system, the neutron generators shall be minimized as much as possible to increasing its practical value.

Generally, the neutron yield of the D-D neutron generator is Exponential growth with the energy of the deuterium ions and linear growth with the increase of the intensity of the deuterium ions. Therefore, the neutron yield can be improved by increasing energy and current of the incident deuterium ions. With the same power at the neutron generator's target, improving the energy of the deuterium ions is more efficient than increasing deuterium ion beams. Therefore, the neutron yield is usually improved by increasing the energy of the incident neutron ions. Besides, neutrons generated by D-D reaction has an angle distribution and the neutron in 0-degree direction has the highest intensity and is the most wanted neutron in some real applications. However, the increasing of the ions energy and current will also complicates the cooling system and make it difficult to using 0-degree direction neutrons. Thus, not only the total yield of the neutron generator but also the neutron flux on the surface of the sample needs to be considered during the development of the neutron generator.

A small-diameter radio frequency ion source based D-D neutron tube is presented in the Chinese patent No. CN102548181A (which was disclosed on Jan. 19, 2012). Although this apparatus is very small, the D-D neutron yield of this neutron tube can only reach the magnitude of $1\times10^8$ $s^{-1}$. In addition, because of its vacuum seal structure, the neutron tube cannot be reused when the target and ion source reaching the end of their lifespan. Two compact D-D neutron generators with a long lifespan are disclosed in the Chinese patent No. CN101978429B (which was disclosed on Apr. 29, 2015) and the Chinese patent No. CN105407621B (which was disclosed on Nov. 13, 2015), respectively. However, the targets of these two neutron generators are all at high-potential end, which will complicate the cooling structure and the neutrons in 0-degree direction cannot be used. A compact multi-hole extraction structure based high-yield D-D neutron generator is disclosed in the Chinese patent No. CN104244560A. However, its target is still at a high-potential end and the distance between the sample inside the neutron generator and the target is relatively large, which will reduce the utilization efficiency of the neutron. In addition, in the aforementioned inventions, the inner side of the neutron generator is not shielded from defocusing ions, which will reduce the lifespan of the neutron generator.

In conclusion, the prior art has the following problems:

(1). Because the target is at the high-potential end, the target cooling system will be complex and the efficiency of the cooling system is reduced. Besides, the working voltage of the neutron generator is limited by the high-voltage feed-in wire, which means the energy of the deuterium beam cannot too high. In addition, due to the target at the high-potential end, a distance between a sample and the target is relatively large, and neutrons in the 0-degree direction cannot be used. Consequently, the efficiency of the neutron generator is low.

(2). The neutron generator is separated from a high-voltage power supply, which is unfavorable to movement of the neutron generation during application.

SUMMARY

In view of the disadvantages of the existing technical solutions, a compact integrated deuterium-deuterium (D-D) neutron generator is proposed in present invention. In the proposed invention, the energy of the deuterium beams is improved and the neutron yield of the neutron generator is further improved. D-D fast neutrons emitted from a 0-degree direction can be directly used and the distance between sample and target is further reduced. The proposed neutron generator has a simplified cooling system, a compact structure, long lifespan, and desirable running stability.

The present invention is implemented as follows: A compact integrated D-D neutron generator includes a cylindrical shell, a cylindrical ceramic shell, a baseplate, a target, and an ion source. The baseplate is disposed at a rear end of the cylindrical shell, so that the cylindrical shell and the baseplate form a shell of the neutron generator; the cylindrical ceramic shell is disposed on an inner wall of the cylindrical shell; a metal head is disposed at an inner front end of the cylindrical ceramic shell, the metal head is hemispherical and is provided therein with an ion source and an ion source power supply; an outer ceramic insulated cylinder is disposed between a metal plate and a baseplate of the metal head and is stuck to an inner wall of the cylindrical ceramic shell, and an inner ceramic insulated cylinder is disposed inside the outer ceramic insulated cylinder; an isolated power supply system and a high-voltage power supply are disposed between the outer ceramic insulated cylinder and the inner ceramic insulated cylinder, the isolated power supply system is electrically connected to the ion source power supply, and an output end of the high-voltage power supply is connected to the metal head; front and rear ends of the outer ceramic insulated cylinder and the inner ceramic insulated cylinder are respectively fixed to the metal plate and the baseplate; an extraction accelerating electrode is disposed inside the inner ceramic insulated cylinder, and a rear end of the extraction accelerating electrode protrudes from the baseplate and is connected to a target holder disposed on the outside of the baseplate; and a target is disposed inside the target holder, the target is at ground potential, a cooling water circulation interface is disposed on the target holder, and a vacuum pump is disposed on the outside of the neutron generator.

Preferably, an ion source extraction plate is disposed on a wall of the metal plate inside the inner ceramic insulated cylinder, and a light-proof shielding electrode is disposed on the ion source extraction plate. The light-proof shielding electrode encompasses a front end of the extraction accelerating electrode, and the high-voltage power supply is electrically connected to the ion source extraction plate and the light-proof shielding electrode. The light-proof shielding electrode can prevent ion sputtering of the ceramic insulated cylinder conductive, thereby improving a lifespan and running stability of the neutron generator.

Preferably, the extraction accelerating electrode is in a cylindrical electrode structure, and an axis of the extraction accelerating electrode coincides with an axis of the ion source.

Preferably, a permanent magnet is fixed on an outer wall of the extraction accelerating electrode, a rear end of the permanent magnet is connected to an inner wall of the baseplate, and the permanent magnet is used to restrain secondary electrons.

Preferably, a front-end head of the extraction accelerating electrode is rounded.

Preferably, the extraction accelerating electrode is welded to the baseplate.

Preferably, the target holder is detachably fixed on a rear end of the extraction accelerating electrode, the target is detachably installed on the target holder, and the target can be replaced.

Preferably, the ion source is a Penning ion source.

Preferably, the cylindrical shell, the metal head, the baseplate, the extraction accelerating electrode, and the light-proof shielding electrode are all made of stainless steel.

Compared with defects and disadvantages in the prior art, the present invention has the following beneficial effects:

(1). In the present invention, the extraction accelerating electrode of the D-D neutron generator is integrated with a power supply system, the high-voltage output end is directly connected to the neutron generator, and no high-voltage cable is needed to feed electricity to the neutron generator. Therefore, energy of deuterium beams can be improved, and neutron yield of the neutron generator is further improved.

(2). In the present invention, the target is at ground potential, so that D-D fast neutrons emitted from a 0-degree direction can be used. In addition, a distance between a sample and the target is reduced, thereby improving a neutron flux on a surface of the sample. In addition, because the target is at ground potential, the target can be cooled by using common water while special cooling materials are needed for high voltage potential target. Therefore, not only requirements for cooling water are reduced, but a loop length of a cooling system is also shortened, a structure of the cooling system is simplified, and cooling efficiency is improved.

(3). In the present invention, the light-proof shielding electrode is disposed between the extraction accelerating electrode and the inner ceramic insulated cylinder, thereby preventing iron sputtering from deteriorating performance of an insulated magnet ring, and improving a lifespan and running stability of the neutron generator.

(4). In the present invention, the extraction accelerating electrode of the neutron generator is integrated with the high voltage power supply system and ion source power supply system, so that the structure of the neutron generator can be reduced further.

BRIEF DESCRIPTION OF THE DRAWINGS

FIG. 1 is a schematic structural diagram of a compact integrated D-D neutron generator according to an embodiment of the present invention.

In the FIGURE, reference numerals are as follows: 1-Metal shell; 2-Ceramic shell; 3-Metal head; 4-Outer ceramic insulated cylinder; 5-Isolated power supply system; 6-an inner ceramic insulated cylinder; 7-Baseplate; 8-Input end of electric supply; 9-Permanent magnet; 10-Cooling water entrance; 11-Target; 12-Target holder; 13-Cooling water exit; 14-Vacuum pump; 15-Extraction accelerating electrode; 16-High-voltage power supply; 17-Ion source extraction plate; 18-Ion source; 19-Light-proof shielding electrode; 20-Ion source power supply; 21-Metal plate.

DETAILED DESCRIPTION

To make the objectives, technical solutions, and advantages of the present invention clearer, the following describes the present invention in more detail with reference to the embodiments. It should be understood that the described embodiments are merely used to explain the present invention, rather than to limit the present invention.

As shown in FIG. 1, the present invention provides a compact integrated D-D neutron generator. A cylindrical shell 1 and a baseplate 7 disposed at a rear end of the cylindrical shell 1 form a shell of the neutron generator. A cylindrical ceramic shell 2 is disposed on an inner wall of the cylindrical shell 1, and the cylindrical ceramic shell 2 is made of 95 alumina ceramics. A metal head 3 is disposed at an inner front end of the cylindrical ceramic shell 2, the metal head 3 is hemispherical and is provided therein with an ion source 18 and an ion source power supply 20.

An outer ceramic insulated cylinder 4 is disposed between a metal plate 21 and a baseplate 7 of the metal head 3 and is stuck to an inner wall of the cylindrical ceramic shell 2, and an inner ceramic insulated cylinder 6 is disposed inside the outer ceramic insulated cylinder 4. An isolated power supply system 5 and a high-voltage power supply 16 are disposed between the outer ceramic insulated cylinder 4 and the inner ceramic insulated cylinder 6. The isolated power supply system 5 is electrically connected to the ion source power supply 20, and an output end of the high-voltage power supply 16 is connected to the metal head 3. The high-voltage power supply 16 supplies power through an electricity input end 8, a maximum output voltage of the high-voltage power supply 16 is 400 kV, and a maximum current is 200 mA. An electricity input end 8 is disposed on the isolated power supply system 5. The isolated power supply system 5 supplies power to the ion source power supply 20, and the isolated power supply system 5 can isolate a high voltage of 450 kV. The ion source power supply 20 supplies power to the ion source 18. The ion source 18 can be a Penning ion source, and the ion source 18 can extract deuterium ion beams of a maximum of 120 mA.

Front and rear ends of the outer ceramic insulated cylinder 4 and the inner ceramic insulated cylinder 6 are respectively fixed to the metal plate 21 and the baseplate 7, so that a closed cavity is formed inside the inner ceramic insulated cylinder 6. A vacuum pump 14 is disposed outside the neutron generator, and the vacuum pump 14 provides a vacuum environment for the cavity of the inner ceramic insulated cylinder 6. An extraction accelerating electrode 15 is disposed inside the inner ceramic insulated cylinder 6. A rear end of the extraction accelerating electrode 15 protrudes from the baseplate 7 and is connected to a target holder 12 disposed outside the baseplate 7. To better fix the extraction accelerating electrode 15, the extraction accelerating electrode 15 is welded to the baseplate at a contact position. A target 11 is disposed inside the target holder 12, and the target 11 is at ground potential. After drifting for a distance inside the extraction accelerating electrode 15, deuterium ions emitted from the ion source 18 arrive at the target 11 at ground potential, and react with a material on the target 11 to generate neutrons. Not only D-D fast neutrons emitted from a 0-degree direction can be used, but a sample can also cling to the outside of a target head during use, a distance between the sample and the target is reduced, and a neutron flux on a surface of the sample is greatly improved.

The extraction accelerating electrode 15 of the D-D neutron generator is integrated with a power supply system, a high-voltage output end is directly connected to the neutron generator, and no electricity needs to be fed to the neutron generator. Therefore, energy of deuterium beams is improved, and neutron yield of the neutron generator is further improved. In addition, an integrated structure makes it convenient to move the neutron generator during use.

The target holder 12 is detachably fixed on a rear end of the extraction accelerating electrode 15, the target 11 is detachably installed on the target holder 12, and the target 11 can be replaced.

A cooling water circulation interface is disposed on the target holder 12. Because the target is at ground potential, the target can be directly cooled by using common water. For example, a cooling water entrance 10 is disposed on the top of the target holder 12, and a cooling water exit 13 is disposed at the bottom of the target holder 12. The target holder 12 is cooled by circulating cooling water. Therefore, not only requirements for the cooling water are reduced, but a loop length of a cooling system is shortened, a structure of the cooling system is simplified, and cooling efficiency is improved.

A specific structure in the inner ceramic insulated cylinder 6 is disposed as follows: An ion source extraction plate 17 is disposed on a wall of the metal plate 21 inside the inner ceramic insulated cylinder 6, a light-proof shielding electrode 19 is disposed on the ion source extraction plate 17, and the light-proof shielding electrode 19 encompasses a front end of the extraction accelerating electrode 15. Therefore, ion sputtering is prevented from deteriorating performance of an insulated magnet ring, and a lifespan and running stability of the neutron generator are improved. The extraction accelerating electrode 15 can be in a cylindrical electrode structure, an axis of the extraction accelerating electrode 15 coincides with an axis of the ion source 18, and rounding processing can be performed on a front-end head of the extraction accelerating electrode 15. The high-voltage power supply 16 is connected to the ion source extraction plate 17 and the light-proof shielding electrode 19.

To restrain secondary electrons, a permanent magnet 9 is fixed on an outer wall of the extraction accelerating electrode 15, and a rear end of the permanent magnet 9 is connected and fixed to an inner wall of the baseplate 7.

The cylindrical shell 1, the metal head 3, the baseplate 7, the extraction accelerating electrode 15, and the light-proof shielding electrode 19 are all made of stainless steel.

In the present invention, through actual running and test, results show that if a Penning ion source is used, when a high voltage is 400 kV and beams on the target are 100 mA, neutron yield is greater than the magnitude of $1.8\times10^{11}$ $s^{-1}$ and a neutron flux on a surface of the sample that is 10 cm away from the target is greater than $3\times10^{8}$ $cm^{-2}s^{-1}$.

The above-mentioned contents are merely preferred embodiments of the present invention, and are not used to limit the present invention, and wherever within the spirit and principle of the present invention, any modifications, equivalent replacements, improvements and the like shall be all contained within the scope of protection of the present invention.

What is claimed is:

1. A compact integrated deuterium-deuterium (D-D) neutron generator, comprising a cylindrical shell having a closed front end, a coaxial cylindrical ceramic shell, a baseplate closing an open rear end of the cylindrical shell, a target, and an ion source having an ion output aligned with the cylindrical axis, wherein the cylindrical ceramic shell is disposed on an inner wall of the cylindrical shell;

a hemispherical metal head and a metal plate are attached to an inner front end of the cylindrical ceramic shell and the ion source and an ion source power supply are disposed within the hemispherical metal head and the metal plate;

an outer coaxial ceramic insulated cylinder is attached to an inner wall of the cylindrical ceramic shell and with a front end fixed to the metal plate and a rear end fixed to the baseplate an inner coaxial ceramic insulated cylinder is spaced apart from and disposed inside the outer ceramic insulated cylinder with a front end fixed to the metal plate and a rear end fixed to the baseplate;

a first power supply system and a high-voltage power supply are disposed between the outer ceramic insulated cylinder and the inner ceramic insulated cylinder, the first power supply system is electrically connected to the ion source power supply, and an output end of the high-voltage power supply is connected to the metal head;

an extraction accelerating electrode is disposed inside the inner ceramic insulated cylinder, and a rear end of the extraction accelerating electrode protrudes from the baseplate and is connected to a target holder disposed on the outside of the baseplate; and the target is disposed inside the target holder, the target is at ground potential, a cooling water circulation interface is disposed on the target holder, and a vacuum pump is disposed on the outside of the baseplate.

2. The compact integrated D-D neutron generator according to claim 1, wherein an ion source extraction plate is disposed on a surface of the metal plate inside the inner ceramic insulated cylinder, a cylindrical shielding electrode is disposed on the ion source extraction plate with a rear end of the shielding electrode axially overlapping a front end of the extraction accelerating electrode, and the high-voltage power supply is electrically connected to the ion source extraction plate and the shielding electrode.

3. The compact integrated D-D neutron generator according to claim 2, wherein the extraction accelerating electrode is a coaxial cylindrical electrode.

4. The compact integrated D-D neutron generator according to claim 2, wherein the extraction accelerating electrode is welded to the baseplate.

5. The compact integrated D-D neutron generator according to claim 3, wherein a permanent magnet is fixed on an outer wall of the extraction accelerating electrode, and a rear end of the permanent magnet is connected to an inner surface of the baseplate.

6. The compact integrated D-D neutron generator according to claim 3, wherein the extraction accelerating electrode is welded to the baseplate.

7. The compact integrated D-D neutron generator according to claim 5, wherein a front-end head of the extraction accelerating electrode is rounded.

8. The compact integrated D-D neutron generator according to claim 5, wherein the extraction accelerating electrode is welded to the baseplate.

9. The compact integrated D-D neutron generator according to claim 7, wherein the extraction accelerating electrode is welded to the baseplate.

10. The compact integrated D-D neutron generator according to claim 1, wherein the extraction accelerating electrode is welded to the baseplate.

11. The compact integrated D-D neutron generator according to 1, wherein the target holder is detachably fixed on the rear end of the extraction accelerating electrode, and the target is detachably installed on the target holder.

12. The compact integrated D-D neutron generator according to 1, wherein the ion source is a Penning ion source.

13. The compact integrated D-D neutron generator according to 1, wherein the cylindrical shell, the metal head, the baseplate, the extraction accelerating electrode, and the shielding electrode are all made of stainless steel.

* * * * *